US006985059B2

(12) United States Patent
Subramanian et al.

(10) Patent No.: US 6,985,059 B2
(45) Date of Patent: Jan. 10, 2006

(54) CIRCUIT BREAKER HANDLE BLOCK

(75) Inventors: Ananthram Subramanian, Secunderbad (IN); Ronald Ciarcia, Bristol, CT (US); Narender Macha, Hyderbad (IN); Luis Brignoni, Tao Baja, PR (US); Paul Douglas Lafferty, Farmington, CT (US)

(73) Assignee: General Electric Company, Schenectady, NY (US)

( * ) Notice: Subject to any disclaimer, the term of this patent is extended or adjusted under 35 U.S.C. 154(b) by 62 days.

(21) Appl. No.: 10/605,124

(22) Filed: Sep. 10, 2003

(65) Prior Publication Data

US 2005/0051414 A1 Mar. 10, 2005

(51) Int. Cl.
*H01H 9/00* (2006.01)

(52) U.S. Cl. ..... 335/172; 335/16; 335/202

(58) Field of Classification Search ..... 335/16, 335/147, 165–176, 185–195, 202, 6; 200/400–401; 218/22, 154

See application file for complete search history.

(56) References Cited

U.S. PATENT DOCUMENTS

| | | | | | |
|---|---|---|---|---|---|
| 4,951,019 | A * | 8/1990 | Gula | 335/166 |
| 5,200,724 | A | 4/1993 | Gula et al. | 335/166 |
| 5,296,664 | A * | 3/1994 | Crookston et al. | 200/401 |
| 5,543,595 | A * | 8/1996 | Mader et al. | 200/401 |
| 5,874,699 | A * | 2/1999 | Beck et al. | 200/244 |
| 6,087,913 | A | 7/2000 | Castonguay et al. | 335/16 |
| 6,114,641 | A | 9/2000 | Castonguay et al. | 200/244 |
| 6,166,344 | A * | 12/2000 | Castonguay et al. | 200/401 |
| 6,175,288 | B1 | 1/2001 | Castonguay et al. | 335/16 |
| 6,218,919 | B1 | 4/2001 | Ciarcia et al. | 335/167 |
| 6,222,143 | B1 * | 4/2001 | Lawson et al. | 200/401 |
| 6,396,369 | B1 | 5/2002 | Schlitz et al. | 335/16 |

* cited by examiner

*Primary Examiner*—Lincoln Donovan
(74) *Attorney, Agent, or Firm*—Cantor Colburn LLP

(57) ABSTRACT

A circuit breaker includes a crank for coupling a rotary arm breaker mechanism to the cradle. The crank has a protrusion which cooperates with a handle yoke to restrict movement of the operating handle when the contacts of the circuit breaker are welded. The crank protrusion is arranged such that it does not interfere with the handle under normal operating conditions.

20 Claims, 5 Drawing Sheets

CIRCUIT BREAKER HANDLE BLOCK

BACKGROUND OF THE INVENTION

The present invention relates generally to circuit breakers and more particularly to circuit breaker operating mechanisms having a handle blocking means for restricting movement of the handle when the current carrying contacts are welded.

Molded case current limiting circuit breakers are well known in the art. Circuit breakers of this type have a manual operating handle for the purpose of switching the circuit breaker between on and off states. The on-off operation is accomplished through a mechanism spring that connects the operating handle with a toggle linkage. The toggle linkage in turn is connected to a contact carrier assembly that performs the operation of connecting and interrupting current flow to a protected circuit.

When the operating handle is moved from the on to the off position, the direction of the force applied by the mechanism spring changes as the spring rotates with the handle. At some point during the motion, the direction of the force changes from one side of a toggle linkage pivot to the other. This results in the toggle linkage collapsing and rotation of the contact carrier assembly.

The circuit breaker generally provides some visual indication as to the position of the contact carrier assembly. However, on extreme and rare occasions the contacts of the circuit breaker can become welded. In this case if the operating handle were allowed to be returned to the off position, it would give the operator the false indication that the protected circuit has been disconnected from the power source. Some regulatory agencies such as the International Electrotechnical Commission (IEC) require that the operating handle be blocked from moving to the off position when the contacts are welded. It is also required by such regulatory agencies that the circuit breaker indicate the position of the contacts. In many circuit breakers when the contacts are welded, the handle automatically returns to the on position. This not only provides correct visual indication of the state of the contacts, but also provides the operator with an indication that there is some malfunction.

A circuit breaker of the type mentioned herein having a mechanism with the toggle type linkage that is described in U.S. Pat. No. 5,200,724. In this circuit breaker the handle movement is blocked by projections extending from both the upper link and the lower link of the toggle linkage. The upper link projection interacts with the handle to block handle rotation while the lower link projection interacts with a crossbar assembly to prevent rotation of the toggle linkage.

Further, U.S. Pat. No. 5,543,595 describes a circuit breaker, which utilizes reversing levers that are attached to a cradle. The reversing levers interact with an upper link and the handle to prevent rotation of the handle to a position where the toggle linkage can rotate if the contacts are welded.

If the weld is of sufficient strength, the contact arm cannot be rotated and the contacts remain closed. Still, it may be possible to rotate the handle to the off position. Furthermore, in some installations, the circuit breaker is operated by a motor operator or other external mechanical means which can force the operating handle to the off position even though the contacts are welded closed. Obviously, this is a very unsatisfactory situation.

Typically a maintenance operator will place the handle of a circuit breaker in the "OFF" position to remove electrical power from the system before doing corrective maintenance.

The maintenance operator may also padlock the handle in this position as an added measure to prevent others from placing the breaker in the "ON position while this maintenance is being done.

Thus, a mechanical means is desired to prevent the maintenance operator from placing the handle in the "OFF" or "RESET" position and possibly padlocking the handle in this position, in the event that contacts should become welded and power cannot be interrupted by handle movement. Further, there is a need for an improved positive off mechanism for a circuit breaker which is rigid enough to block movement of the operating handle to the off position despite the application of a force to the operating handle to the "OFF" position when the contacts are welded closed.

BRIEF DESCRIPTION OF THE INVENTION

The above discussed and other drawbacks and deficiencies of the prior art are overcome or alleviated by a circuit breaker having a crank for coupling a rotary arm breaker mechanism to the cradle. The crank has a protrusion which cooperates with a handle yoke to restrict movement of the operating handle when the contacts of the circuit breaker are welded. The crank protrusion is arranged such that it does not interfere with the handle under normal operating conditions.

In an exemplary embodiment of the present invention, a molded case circuit breaker includes a mechanism having a handle, movable between an on and off position, with the handle being configured to restrict movement thereof when the contacts of the circuit breaker are welded or otherwise fixed in the ON position and prevented from opening. The handle includes a handle yoke having a projection extending therefrom and being movable between an on position and an off position with the handle. A contact arm supports at least one contact and is movable between a closed position and an open position. A crank is operably coupled to the handle yoke and the contact arm to move the contact arm from the closed position to the open position when the handle yoke is moved from the on position to the off position. The crank has a blocking lever or protrusion extending therefrom interacting with the projection of the handle yoke to prevent the handle yoke from being moved to the off position when the contact arm is fixed in the closed position.

BRIEF DESCRIPTION OF THE DRAWINGS

Referring now to the drawings wherein like elements are numbered alike in the several FIGURES.

DETAILED DESCRIPTION OF THE INVENTION

Figure 1:
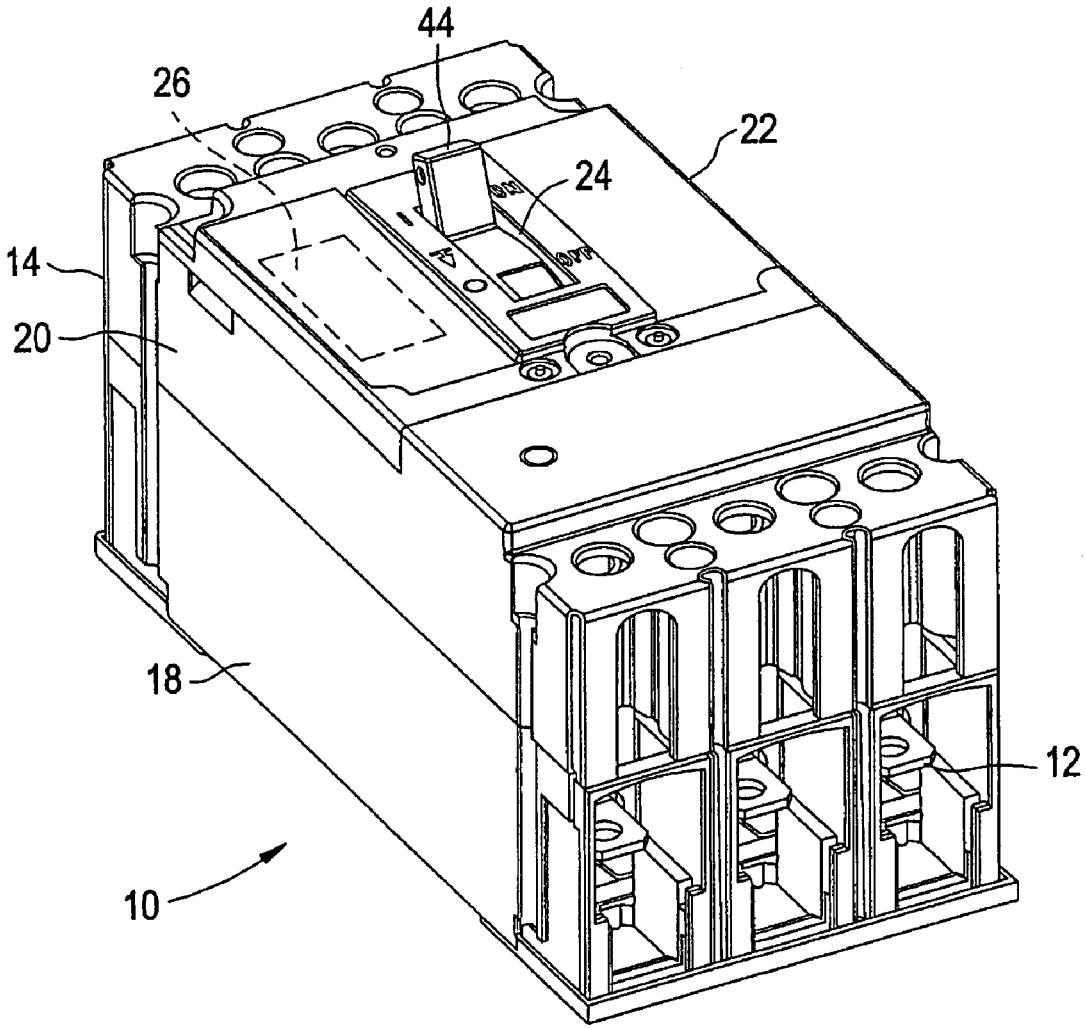
FIG. 1 is a top perspective view of a molded case circuit breaker.

Ueferring to FIG. 1, a top perspective view of a molded case circuit breaker 10 is generally shown. Molded case circuit breaker 10 is generally interconnected within a protected circuit between multiple phases of a power source (not shown) at line end 14 and a load to be protected (not shown) at load end 12. Molded case circuit breaker 10 includes a base 18, a mid cover 20 and a top cover 22 having a toggle handle 44 (operating handle) extending through an opening 24. Toggle handle 44 is interconnected with a circuit breaker operating mechanism 38 (FIG. 2) and allows for external operation of cassettes 32, 34 and 36. A switch (e.g., a bell alarm switch and or auxiliary switch) 26 may be positioned within the mid cover 20 as shown in phantom, and interfaces with circuit breaker operating mechanism 38. The circuit breaker in FIG. 1 shows a typical three phase configuration, however, the present invention is not limited to this configuration but may be applied to other configurations, such as the typical one, two or four phase circuit breakers.

Figure 2:
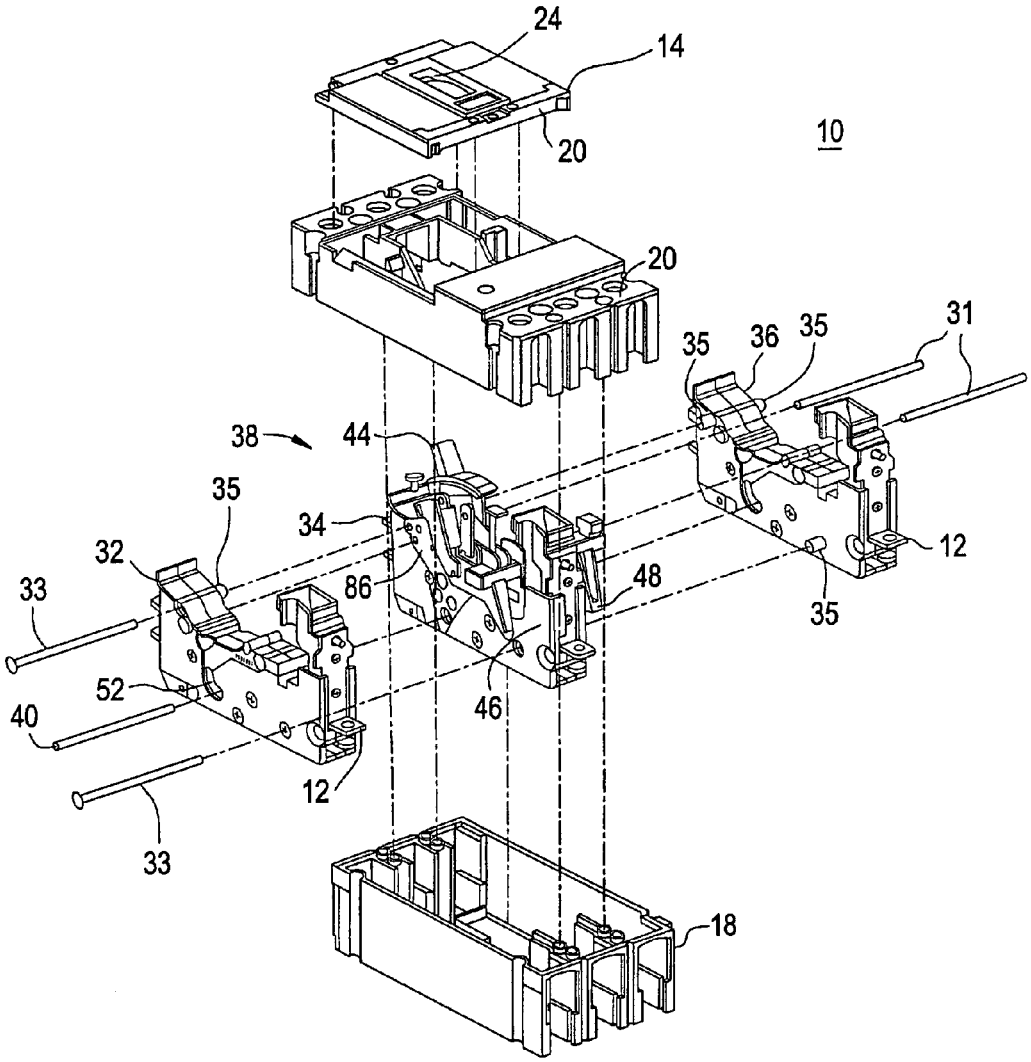
FIG. 2 is an exploded perspective view of a molded case circuit breaker.

Referring now to FIG. 2, an exploded view of molded case circuit breaker 10 is provided. A series of circuit breaker cassettes 32, 34, 36 are generally well known and may be, for example, of the rotary type. Examples of rotary contact structures that may be operated by operating mechanism 38 are described in more detail in U.S. Pat. Nos. 6,114,641 and 6,396,369, both entitled "Rotary Contact Assembly For High-Ampere Rated Circuit Breakers", and U.S. Pat. No. 6,175,288, entitled "Supplemental Trip Unit For Rotary Circuit Interrupters".

Circuit breaker cassettes 32, 34, 36 are seated approximately upstanding within base 18, and the cassette 34 includes operating mechanism 38 positioned thereon. The individual phases of current are divided into three phases, wherein each phase passes through one of the circuit breaker cassettes 32, 34, 36. Each of cassettes 32, 34, 36 includes one or more contact pairs therein for passage of current when the contacts are closed and for preventing passage of current when the contact pairs are opened. It is contemplated that the number of phases, or specific type of cassette utilized, can vary according to factors including, but not limited to, the type of load circuit being protected and the type of line input being provided to the circuit breaker 10.

Still referring to FIG. 2, each cassette 32, 34, 36 is commonly operated by a first cross bar (cross pin) 40 that interfaces with the internal mechanisms of cassettes 32, 34, 36 such that when one of cassettes 32, 34, 36 are opened or closed, the other cassettes 32, 34, 36 will operate cooperatively. It will be recognized by one skilled in the pertinent art that only one cross bar may be used to interface with the internal mechanisms of cassettes 32, 34, 36 such that when one of cassettes 32, 34, 36 are opened or closed, the other cassettes 32, 34, 36 will operate cooperatively. Positioning rods 33 and protrusions 35 in cassettes 32, 36 are also employed to position the cassettes 32, 34, 36 adjacent to each other. Positioning rods 31 are also used to position mechanism 38 to locate cross bar 40 to align with rotary contact assembly 56 within cassettes 32, 34, 36. Operating mechanism 38 is positioned and configured atop cassette 34, which is generally disposed intermediate to cassettes 32 and 36. Operating mechanism 38 operates substantially as described herein and as described in U.S. Pat. No. 6,218,919, entitled "Circuit Breaker Latch Mechanism with Decreased Trip Time". It should also be noted that employment of other operating mechanisms is contemplated, as well. The cassettes 32, 34, 36 are typically formed of high strength plastic material and each include opposing sidewalls.

Figure 3:
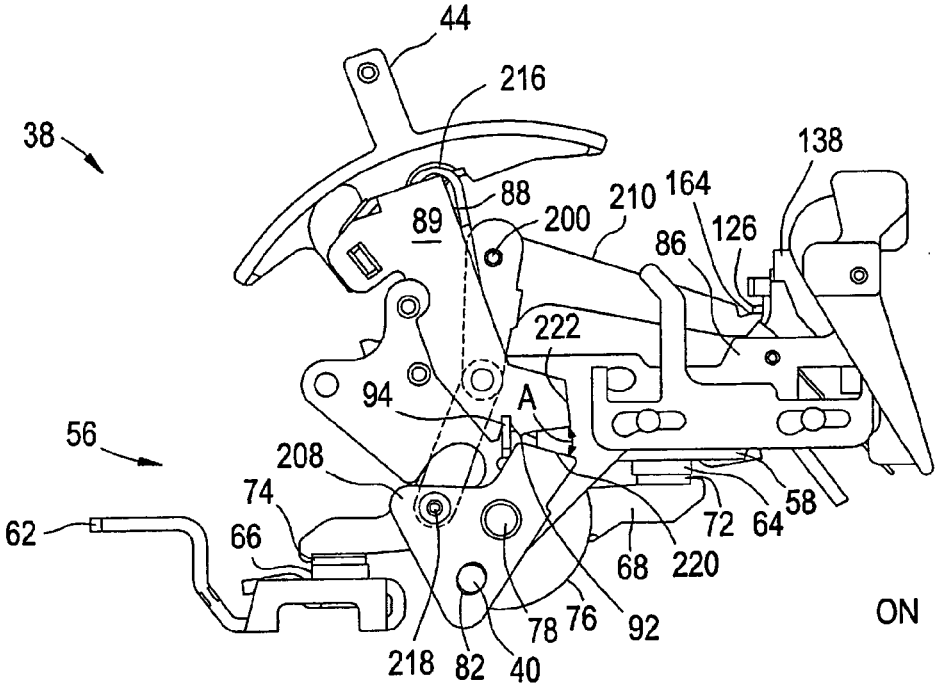
FIG. 3 a partial sectional view of the rotary contact structure and operating mechanism of FIG. 3 in the "on" position.
Figure 4:
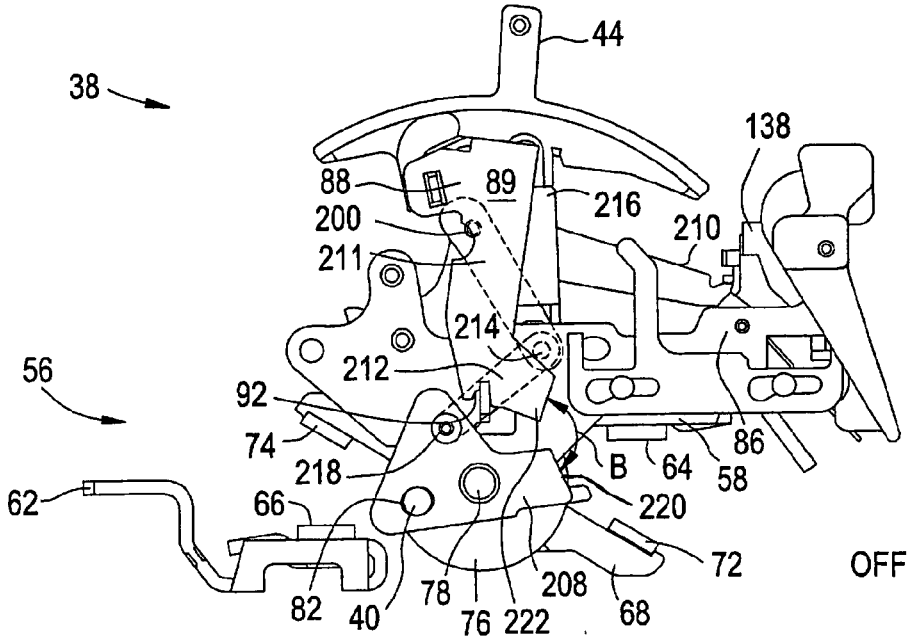
FIG. 4 is a partial sectional view of a rotary contact structure and operating mechanism embodied by the present invention in a "off" position.
Figure 5:
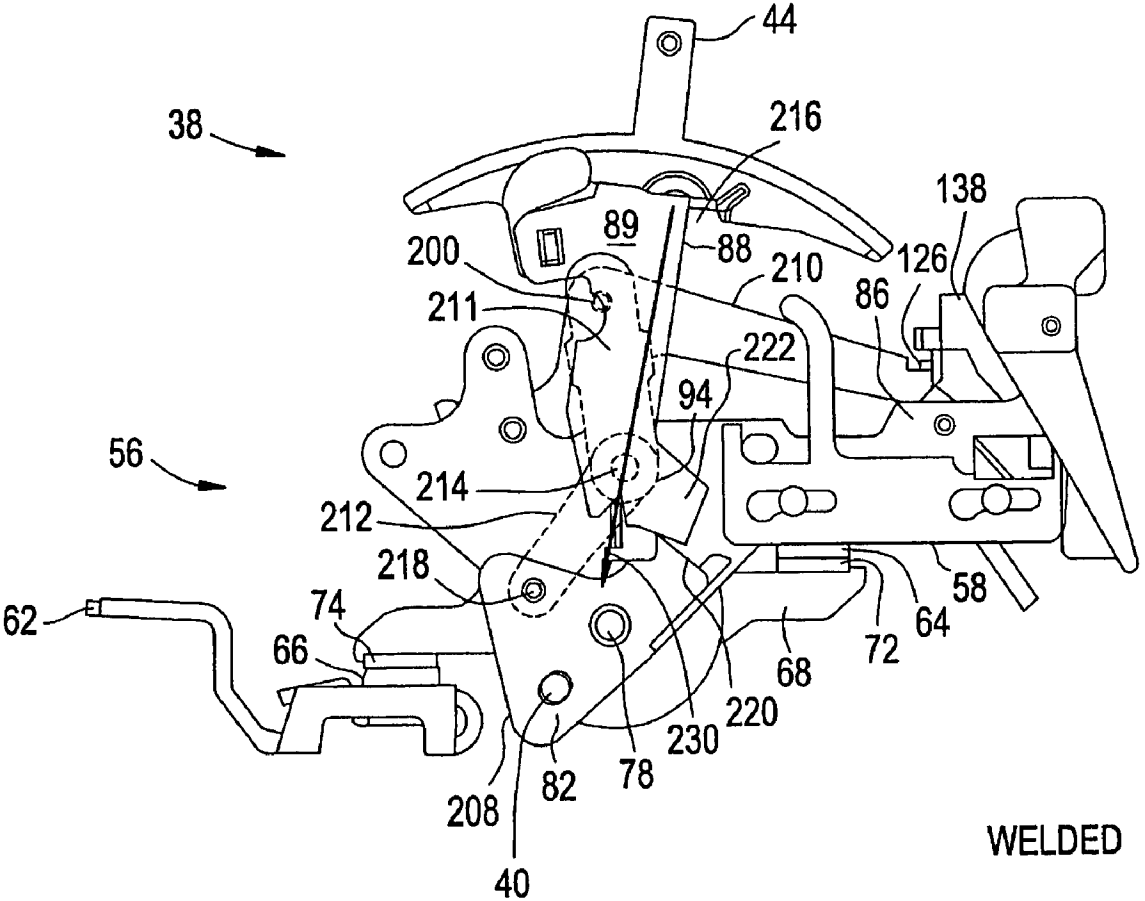
FIG. 5 is a partial sectional view of a rotary contact structure and operating mechanism embodied by the present invention in an "on" position having the contacts in a welded position as the operating handle is attempted to be moved toward an "off" position.

Referring now to FIGS. 3, 4, and 5, the operating mechanism 38 will now be detailed. An exemplary rotary contact assembly 56 is shown disposed within each cassette 32, 34, 36 and shown in the "on", "off" and "welded" conditions, respectively. Also depicted are partial side views of operating mechanism 38, the components of which are described in greater detail further herein. Rotary contact assembly 56 includes a load side contact strap 58 and line side contact strap 62 for connection with a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 4) of operating mechanism 38, wherein toggle handle 44 is oriented slightly off center to the right (e.g., via a manual or mechanical force), contacts 72 and 74 are separated from stationary contacts 64 and 66, thereby preventing current from flowing through contact arm 68.

In the "on" position (FIG. 3) of operating mechanism 38, wherein toggle handle 44 is oriented to the left as depicted in FIG. 4 (e.g., via a manual or mechanical force), contacts 72 and 74 are mated with stationary contacts 64 and 66, thereby allowing current to flow through contact arm 68. In the "welded" position (FIG. 5) of operating mechanism 38, toggle handle 44 is attempted to be oriented between the "on" position and the "off" position (typically by either the release of mechanism springs within operating mechanism 38 or manipulation of handle 44 to the "off" position, described in greater detail herein). In this "welded" position, contacts 72 and 74 are welded to stationary contacts 64 and 66 and power cannot be interrupted by handle 44 movement or by the action of operating mechanism 38, thereby maintaining current flowing through contact arm 68. Once the welded contacts are separated or after the operating mechanism 38 is in the "tripped" position (See FIG. 6), it must ultimately be returned to the "on" position for operation. This is effectuated by applying a reset force to move toggle handle 44 to a "reset" condition, which is beyond the "off" position (i.e., further to the left of the "off" position in FIG. 4), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Referring now to FIGS. 3, 4, 5, and 6, the components of operating mechanism 38 will now be described in further detail in relation to interfacing between the operating mechanism 38 and the rotor contact assembly 56. As viewed in FIG. 3, operating mechanism 38 is in the closed or "on" position after being reset. Operating mechanism 38 has operating mechanism side frames 86 configured and positioned to straddle sidewalls 46, 48 of cassette 34 (FIG. 2).

Toggle handle 44 is rigidly interconnected with a drive member or handle yoke 88. Handle yoke 88 includes opposing side portions (only one shown) 89. Each side portion 89 includes a U-shaped portion 92 at the bottom portion of each side portion 89. U-shaped portions 92 are rotatably positioned on a pair of bearing portions 94 protruding outwardly from side frames 86.

Operating mechanism 38 has a pair of cranks 208 operably connected to a cradle 210. Examples of rotary contact structures having such a cradle that may be operated by operating mechanism 38 are described in more detail in U.S. patent application Ser. No. 09/795,017 filed 27 Feb. 2001. Each crank 208 pivots about a center 78. Crank 208 has an opening corresponding with opening 82 within rotor structure 76 where a cross pin 40 (FIG. 2) passes through into arcuate passage 52 of cassettes 32, 34 and 36 (FIG. 2).

Still referring to FIG. 3, cradle 210 is disposed adjacent to corresponding side frames 86 and pivots with respect to a cradle pivot pin 201 disposed through a corresponding opening (not shown) disposed in cradle 210. Cradle 210 includes a top edge surface including a cradle latch surface 164 disposed at one end thereof. Upper link pivot pin 200 is pivotally connected to the cradle 210 and to an upper link 211 that is pivotally connected to a lower link 212 at an opposite end via a rivet or toggle pin 214. An opposite end of lower link 212 in turn is pivotally coupled to crank 208 via a pin 218.

A primary latch 126 is positioned within side frame 86. A secondary latch 138 is pivotally positioned within side frames 86. Secondary latch 138 extends from operating mechanism 38 as to allow an interface with, for example, a shunt trip (not shown), or a thermal magnetic trip unit (not shown) to release the engagement between primary latch 126 and secondary latch 138 thereby causing operating mechanism 38 to move to the "tripped" position (in FIG. 6), described below. Secondary latch 138 includes a latch surface generally shown at 139 that aligns with a corresponding primary latch surface to release primary latch 126. The interface between primary latch 126 and secondary latch 138 (i.e., between primary latch surface and secondary latch surface), and between cradle 210 and primary latch 126 is not affected when a force is applied to toggle handle 44 to change from the "off" position to the "on" position.

Figure 6:
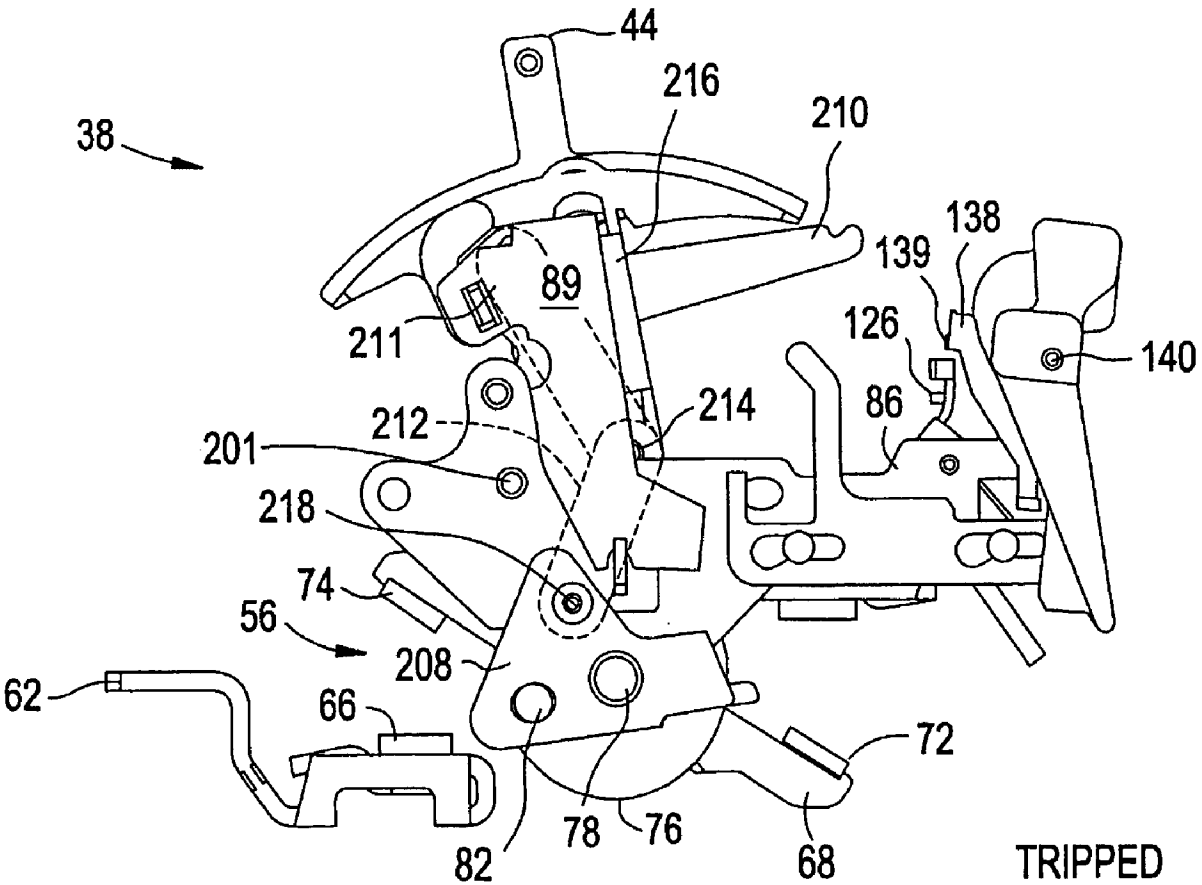
FIG. 6 is a partial sectional view of a rotary contact structure and operating mechanism embodied by the present invention in a "tripped" position.

Referring now to FIG. 6, in the "tripped" condition, secondary latch 138 has been displaced (e.g., by a thermal magnetic trip unit not shown) when secondary latch 138 pivots clockwise about a trip lever pin 140, and the interface between primary latch 126 and secondary latch 138 is released. The primary latch 126 is disengaged from cradle latch surface 164 (e.g., by rotating clockwise), and cradle 210 is rotated counter-clockwise about the cradle pivot pin 201 (shown in FIG. 6). The movement of cradle 210 transmits a force to crank 208 via pin 200 corresponding to upper link 211 connected to lower link 212 with corresponding rivet 214 (as best seen with reference to FIG. 5 and shown with phantom lines in FIGS. 3, 4, and 6), the lower link 212 causing crank 208 to rotate counter clockwise about center 78 and drive cross pin 40 to an upper portion of the arcuate passage 52 configured in the cassette. The forces transmitted through cross pin 40 to rotary contact assembly 56 via opening 52 cause movable contacts 72, 74 to separate from stationary contacts 64, 66 (see FIGS. 4 and 6), unless the movable contacts 72, 74 become welded to stationary contacts 64, 66 (see FIG. 5).

The remaining internal components of the circuit breaker are described with reference to the Figures where handle 44 is attached to a mechanism spring 216 within an arcuate cavity configured therein which attaches at its opposite end to toggle pin 214. The toggle pin 214 connects the toggle linkage 211, 212 with the mechanism spring 216. As will be described herein, the force generated by the movement of the handle 44 will cause the toggle linkage 211, 212 to extend or collapse, which in turn results in the circuit breaker turning ON or OFF depending on the movement of the handle 44. The upper link 211 of the toggle linkage attaches to cradle 210 at pin 200. The lower link 212 attaches to crank 208 via pin 218.

The crank 208 pivots on pin 78 attached to the side frames 86 and connects with a multi-pole rotary contact system 56 via pin 40. The rotary contact system operates in substantially the same manner as that described in U.S. patent application titled "Circuit Breaker Mechanism for a Rotary Contact Assembly" Ser. No. 09/196,706 filed on Nov. 20, 1998 which is incorporated herein by reference. Opposite pin 40, the crank 208 includes a blocking lever 220 extending therefrom. Under certain operations, the blocking lever 220 interacts with a handle yoke projection 222 (as best seen with reference to FIG. 5). The importance of the interaction between the lever projection 220 and the handle yoke projection 222 will be made clearer herein.

Under normal operating conditions when the circuit breaker is in the ON position, the mechanism 38 and rotary contact system 56 will be oriented as shown in FIG. 3. In this orientation, the movable contacts 72, 74 mate with the stationary contacts 64, 66 to allow current to flow through the circuit breaker. In this position, there is a small angle A between the mating surfaces of blocking lever 220 and the handle yoke projection 222 corresponding to a small gap therebetween.

When the user rotates the handle 44 to the OFF position (clockwise as oriented in FIGS. 3–6), the line of force generated by the mechanism spring 216 on the toggle pin 214 rotates with the handle. At the point where the line of force generated by the mechanism spring 216 crosses the upper link pin or cradle pivot pin 200, the toggle linkage 211, 212 will collapse as shown in FIG. 4. This collapsing of the toggle linkage 211, 212 rotates crank 208 in the clockwise direction separating the moveable contacts 72, 74 from the stationary contacts 64, 66. When the contacts 64, 66, 72, 74 separate, electrical current flow through the circuit breaker is interrupted and the protected circuit is disconnected from the power source.

As the crank 208 continues to rotate to an angle B, the mating surfaces of blocking lever 220 and the handle yoke projection 222 correspond to a large gap therebetween. Since at this point the mating surface of the blocking lever 220 has rotated clockwise as illustrated in FIG. 4, the handle yoke projection 222 is not in contact with the crank 208 via lever 220 extending therefrom. The handle yoke projection 222 is free to rotate thereby not interfering with the blocking lever 220 and the user can rotate the handle 44 to the full OFF position shown in FIG. 4.

Under certain conditions, the contacts 64, 66, 72, or 74 may become welded together. This welded condition prevents the mechanism 38 from separating the contacts 64, 66, 72, 74 as described above to disconnect the protected circuit. Certain quasi-regulatory agencies such as the International Electrotechnical Commission (IEC) require that the mechanism handle 44 be prevented from moving to the OFF position while the contacts 64, 66, 72, 74 are welded. To accomplish this, the present invention configures blocking lever 220 extending from crank 208 to interfere with the handle yoke projection 222 extending from handle yoke 88 to prevent the handle 44 from being placed in the OFF position and if the handle 44 is moved, it will automatically return to the ON position when the handle 44 is released.

When the contacts 64, 66, 72, 74 are welded, the crank 208 will stay in the closed position shown in FIG. 5. If the user attempts to reset the breaker, the handle yoke 88 rotates until the yoke projection 222 contacts the mating surface of the blocking lever 220. Unlike the above situation, where the bias on the blocking lever 220 allowed the blocking lever 220 to rotate out of the path of the handle yoke projection 222, the blocking lever is motionless as it is extends from crank 208 which in turn is operably connected to the rotor arm assembly 56 having welded contacts 64, 66, 72, 74. Thus, the blocking lever 220 is prevented from rotating clockwise. Once the handle yoke projection 222 is interfered with by the mating surface of blocking lever 220, further clockwise rotation of the handle 44 is prevented. It should be appreciated that once the handle 44 is released by the user, the line of force 230 on the handle 44 from the mechanism spring 216 will cause the handle yoke 88 and the handle 44 to rotate in the counter-clockwise direction about the handle yoke pivot or bearing portions 94 until it reaches the ON position.

Thus, a method and mechanical means is provided to prevent a user from moving the handle to the OFF or RESET position and possibly padlocking the handle in this position in the event that a contact becomes welded. The above-described method and mechanical means provides a cost effective means to employ handle blocking in a circuit breaker. More specifically, the above-described method and mechanical means for handle blocking is accomplished by modifying one component of the operating mechanism and one of the components of the rotary arm assembly for engagement therebetween in the event of welded contacts, thereby preventing movement of the handle to the OFF or RESET positions.

While the invention has been described with reference to an exemplary embodiment, it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

a base and a cover;

a cassette disposed within said base;

an operating mechanism disposed atop said cassette with a handle yoke having a projection extending therefrom, said handle yoke being movable between an on position and an off position;

a rotary contact structure disposed with said cassette, said rotary contact structure having a contact arm supporting at least one contact, said contact arm being movable between a closed position and an open position; and a crank operably coupled to said handle yoke and said rotary contact structure to move said contact arm from the closed position to the open position when said handle yoke is moved from the on position to the off position, said crank having a blocking lever extending therefrom, said blocking lever interacting with said projection of said handle yoke to prevent said handle yoke from being moved to the off position when said contact arm is fixed in the closed position.

2. The circuit breaker of claim 1, wherein:

said projection further comprises a first surface; and said blocking lever further comprises a second surface cooperating with said first surface such that rotation of said blocking lever when said contact arm moves between the closed and open positions, without said blocking lever interacting with said projection of said handle yoke.

3. The circuit breaker of claim 2, wherein when said contact arm is prevented from moving between closed and open positions, said second surface of said blocking lever interacts with said first surface of said projection of said handle preventing movement of said handle yoke to the off position.

4. The circuit breaker of claim 1, wherein said blocking lever is integrally formed with said crank.

5. The circuit breaker of claim 1 wherein said at least one contact comprises a pair of contacts, each of said contacts located at an opposing end of said contact arm.

6. The circuit breaker of claim 1 further comprising:

a cradle;

a toggle linkage having an upper link and a lower link, said upper link being pivotally attached to said cradle at one end and to a toggle pivot at an opposite end, said lower link being pivotally attached to said toggle pivot at one end and to said crank at an opposite end; and a spring connected between said toggle pivot and said handle yoke to bias said crank in a direction for moving said contact arm to an open position when said handle yoke is moved from an off to on position.

7. The circuit breaker of claim 6 wherein:

said crank and said contact arm rotate on a common axis and said crank is coupled to said lower link at a first pin and said crank is coupled to said contact arm by a second pin, said second pin being offset from said axis.

8. The circuit breaker of claim 7 wherein said second pin is diametrically opposed to said first pin.

9. The circuit breaker of claim 7 wherein said blocking lever extends from said crank opposite said first pin with said common axis therebetween.

10. The circuit breaker of claim of claim 7 wherein said blocking lever is diametrically opposed to said first pin and said second pin.

11. The circuit breaker of claim 6, wherein said spring biases said handle to the on position in response to said contact arm being fixed in the closed position and said handle being driven to the off position.

12. A method to prevent movement of a handle yoke to an off position from an on position when circuit breaker contacts are fixed to the on position, the circuit breaker contacts being disposed within a cassette that is disposed within a base of the circuit breaker, the cassette being configured to operably connect with one phase of a power source, the method comprising:

configuring a handle yoke having a projection extending therefrom, said handle yoke being movable between an on position and an off position, said handle yoke being integral part of an operating mechanism that sits atop the cassette;

aligning a contact arm supporting at least one contact with a corresponding contact, said contact arm being movable between a closed position and an open position within the cassette;

operably coupling a crank to said handle yoke and said contact arm to move said contact arm from the closed position to the open position when said handle yoke is moved from the on position to the off position; and configuring said crank having a blocking lever extending therefrom, said blocking lever interacting with said projection of said handle yoke to prevent said handle yoke from being moved to the off position when said contact arm is fixed in the closed position.

13. The method of claim 12 further comprising configuring said projection with a first surface; and configuring said blocking lever with a second surface cooperating with said first surface such that rotation of said blocking lever when said contact arm moves between the closed and open positions, without said blocking lever interacting with said projection of said handle yoke.

14. The method of claim 13, wherein when said contact arm is prevented from moving between closed and open positions, said second surface of said blocking lever interacts with said first surface of said projection of said handle preventing movement of said handle yoke to the off position.

15. The method of claim 12 further comprising: integrally forming said blocking lever with said crank.

16. The method of claim 12 wherein said at least one contact comprises a contact located at one end of said contact arm.

17. The method of claim 12 wherein said at least one contact comprises a pair of contacts, each of said contacts located at an opposing end of said contact arm.

18. The method of claim 12 further comprising:

employing a toggle linkage having an upper link and a lower link;

pivotally attaching said upper link to a cradle at one end and to a toggle pivot at an opposite end;

pivotally attaching said lower link being attached to said toggle pivot at one end and to said crank at an opposite end; and connecting a spring between said toggle pivot and said handle yoke to bias said crank in a direction for moving said contact arm to an closed position when said handle yoke is moved from an off to on position.

19. The method of 18 further comprising:

configuring said crank and said contact arm to rotate on a common axis; and coupling said crank to said lower link at a first pin and coupling said crank to said contact arm by a second pin, such that said second pin is offset from said axis.

20. The circuit breaker of claim 1, wherein said cassette is a first cassette and said rotary contact structure is a first rotary contact structure, and further comprising:

a second cassette comprising a second rotary contact structure disposed therein, wherein said first cassette has a first opening in a sidewall thereof and said second cassette has a second opening in a sidewall thereof; and a cross pin operably coupling said first rotary contact structure to said second rotary contact structure via said first and second openings and said crank.

* * * * *